US008073347B2

(12) United States Patent
Harashima et al.

(10) Patent No.: US 8,073,347 B2
(45) Date of Patent: Dec. 6, 2011

(54) IMAGE FORMING APPARATUS

(75) Inventors: Yasumitsu Harashima, Kanagawa (JP); Tomoaki Yoshioka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 111 days.

(21) Appl. No.: 12/766,471

(22) Filed: Apr. 23, 2010

(65) Prior Publication Data

US 2011/0158662 A1 Jun. 30, 2011

(30) Foreign Application Priority Data

Dec. 24, 2009 (JP) ..... 2009-293458

(51) Int. Cl.
*G03G 15/08* (2006.01)

(52) U.S. Cl. ..... 399/27; 399/48; 399/55; 399/56

(58) Field of Classification Search ..... 399/9, 27–29, 399/38, 46, 48, 53–56
See application file for complete search history.

(56) References Cited

U.S. PATENT DOCUMENTS 7,734,206 B2 * 6/2010 Ishida ..... 399/58
7,860,413 B2 * 12/2010 Hayashi ..... 399/28
7,970,305 B2 * 6/2011 Okuno et al. ..... 399/55
7,974,568 B2 * 7/2011 Yamasaki et al. ..... 399/396

FOREIGN PATENT DOCUMENTS

| | | |
|---|---|---|
| JP | A-7-199639 | 8/1995 |
| JP | A-2007-47711 | 2/2007 |
| JP | A-2008-3963 | 1/2008 |

* cited by examiner

*Primary Examiner* — Hoan Tran
(74) *Attorney, Agent, or Firm* — Oliff & Berridge, PLC

(57) ABSTRACT

An image forming apparatus includes an image holder, a latent image forming unit, and a developing unit, the developing unit including a developer holder that is disposed to face the image holder and holds developer. Also included is a developer container, replenishing unit that replenishes new developer to the developing unit, a discharge unit that discharges the developer, a calculation unit that calculates an image area coverage of a toner image formed on the image holder, an obtaining unit that obtains a potential difference between the developer holder and the image portion on the image holder, and a controller that increases a discharge amount of the developer, when the image area coverage calculated by the calculation unit is smaller than a predetermined reference image area coverage, and the potential difference obtained by the obtaining unit is larger than a predetermined reference potential difference.

8 Claims, 11 Drawing Sheets

IMAGE FORMING APPARATUS

CROSS-REFERENCE TO RELATED APPLICATIONS

This application is based on and claims priority under 35 USC 119 from Japanese Patent Application No. 2009-293458 filed on Dec. 24, 2009.

BACKGROUND

Technical Field

The present invention relates to an image forming apparatus for forming an image by using developer containing carrier and toner.

SUMMARY

According to an aspect of the invention, there is provided an image forming apparatus comprising: an image holder; a latent image forming unit that forms an electrostatic latent image containing an image portion and a background portion on the image holder; a developing unit that develops the electrostatic latent image formed on the image holder with toner, the developing unit including a developer holder that is disposed to face the image holder and holds developer containing the toner and carrier, and a developer container that contains the developer to be supplied to the developer holder; a replenishing unit that replenishes new developer to the developing unit; a discharge unit that discharges from the developing unit the developer contained in the developing unit; a calculation unit that calculates an image area coverage of a toner image formed on the image holder; an obtaining unit that obtains a potential difference between the developer holder and the image portion on the image holder; and a controller that increases a discharge amount of the developer to be discharged from the developing unit by the discharge unit when the image area coverage calculated by the calculation unit is smaller than a predetermined reference image area coverage, and the potential difference obtained by the obtaining unit is larger than a predetermined reference potential difference.

BRIEF DESCRIPTION OF THE DRAWINGS

Exemplary embodiments of the present invention will be described in detail based on the following figures, wherein.

DETAILED DESCRIPTION

An exemplary embodiment according to the present invention will be described hereunder with reference to the accompanying drawings.

Figure 1:
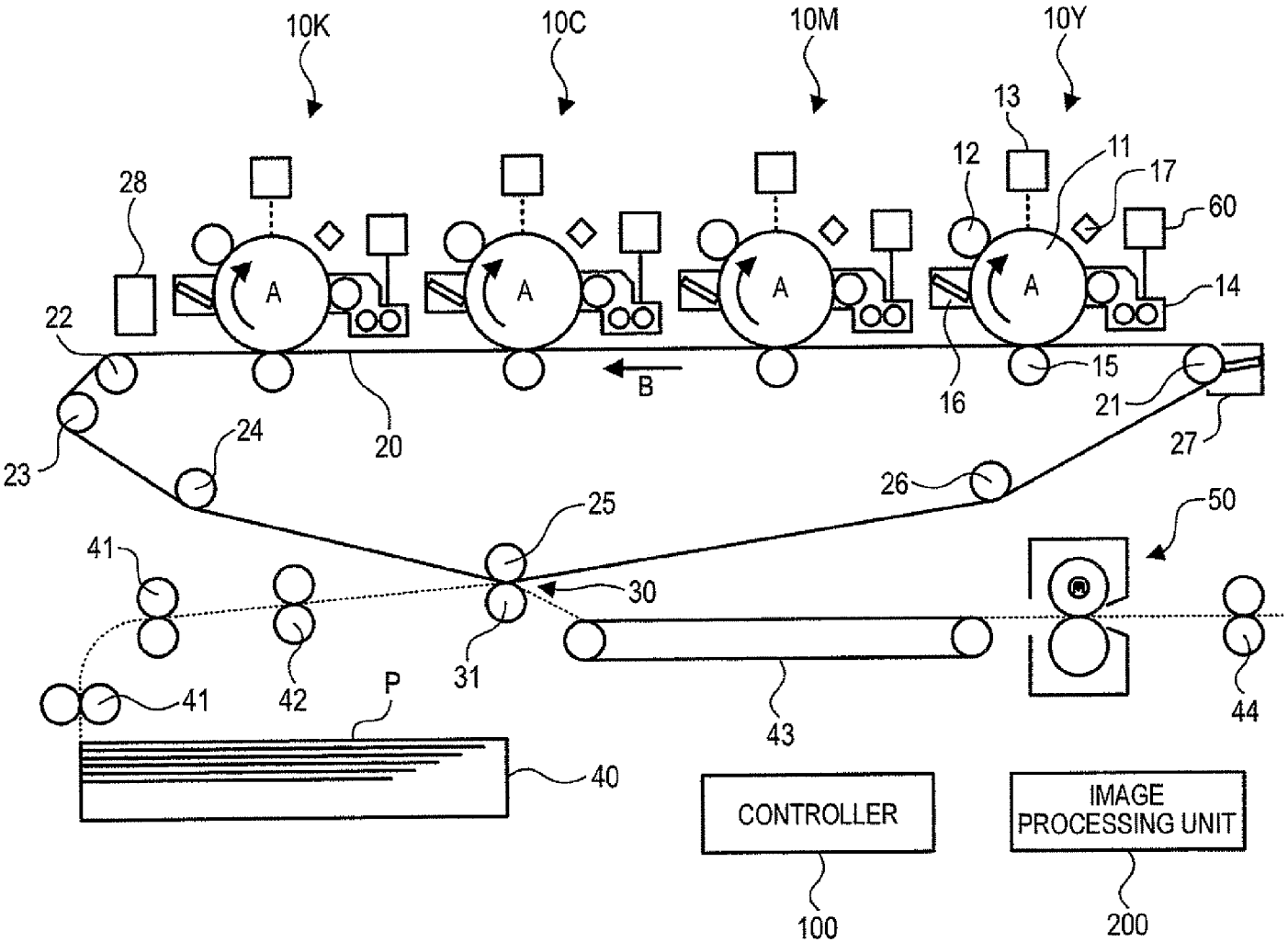
FIG. 1 is a diagram showing an outline of an image forming apparatus according to an exemplary embodiment.

FIG. 1 is a schematic diagram showing an image forming apparatus 1 according to an exemplary embodiment of the present invention.

The image forming apparatus 1 has plural (four in this exemplary embodiment) image forming units 10 (specifically, 10Y, 10M, 10C, 10K) for forming toner images of respective color components, for example, electrophotographically, an intermediate transfer belt 20 to which the toner images of the respective color components formed by the respective image forming units 10 are successively primarily transferred and held, a secondary transfer device 30 for secondarily transferring onto a sheet P the images which are transferred and superposed onto the intermediate transfer belt 20, and a fixing device 50 for fixing the secondarily transferred images on the sheet P.

The respective image forming units 10 have the same configuration except for colors of toner being used. Here, the image forming unit 10Y for yellow color will be representatively described.

The image forming unit 10Y of yellow has a photoconductive drum 11 which has a metal pipe and a photoconductive layer formed on the peripheral surface of the metal pipe (not shown) and is disposed so as to be rotatable in a direction of an arrow A. A charging roll 12, an exposure unit 13, a developing unit 14, a primary transfer roll 15, a drum cleaner 16 and a potential sensor 17 are disposed around the photoconductive drum 11 as an example of the image holder. The charging roll 12 is rotatably disposed in contact with the photoconductive drum 11, and charges the photoconductive drum at charging potential VH (negative potential in this exemplary embodiment). The exposure unit 13 selectively applies a beam to the photosensitive drum 11 charged by the charging roll 12, thereby forming an electrostatic latent image containing a site which is kept at the charging potential VH because it is not exposed to the beam and a site which potentially varies from the charging potential VH to exposure potential VL (negative potential whose absolute value is smaller than that of the charging potential VH in this exemplary embodiment). The developing unit 14 accommodates developer containing toner of a corresponding color component (for example, yellow toner in the image forming unit 10Y of yellow), and develops the electrostatic latent image on the photoconductive drum 11 by this toner.

In this exemplary embodiment, the toner is charged to a negative polarity, and the thus-charged toner selectively adheres to an exposed area (an area kept at the exposure potential VL) on the photoconductive drum 11 by so-called inversion phenomenon. The primary transfer roll 15 primarily transfers a toner image formed on the photoconductive drum 11 onto the intermediate transfer belt 20. The drum cleaner 16 removes toner, etc. on the photoconductive drum 11 after the primary transfer. A potential sensor 17 measures the charging potential VH of the photoconductive drum 11 charged by the charging roll 12 and the exposure potential VL of the photoconductive drum 11 exposed to light by the exposure unit 13. The metal pipe constituting the photoconductive drum 11 is grounded. In this exemplary embodiment, the charging roll 12 and the exposure unit 13 function as an example of a latent image forming unit.

The intermediate transfer belt 20 is rotatably supported by plural (six in this exemplary embodiment) support rolls. A driving roll 21 of these support rolls drives and rotates the intermediate transfer belt 20. Driven rolls 22, 23 and 26 of the support rolls are driven and rotated interlockingly with the intermediate transfer belt 20 driven by the driving roll 21. A correcting roll 24 functions to regulate meandering of the intermediate transfer belt 20 in a direction intersecting to a carrying direction of the intermediate transfer belt 20. Furthermore, a backup roll 25 also functions as a constituent member of a secondary transfer device 30 described later.

A belt cleaner 27 for removing residual toner, etc. on the intermediate transfer belt 20 after secondary transfer is disposed so as to face the driving roll 21 through the intermediate transfer belt 20. An image density sensor 28 for detecting the density of a toner image of each color which is primarily transferred onto the intermediate transfer belt 20 is disposed so as to face the intermediate transfer belt 20.

The secondary transfer device 30 has a secondary transfer roll 31 disposed in contact with the toner image holding surface side of the intermediate transfer belt 20, and backup roll 25 which is disposed at the back surface side of the toner image holding surface of the intermediate transfer belt 20 and serves as a counter electrode to the secondary transfer roll 31.

A sheet transporting system includes a sheet tray 40, a transporting roll 41, a registration roll 42, a transporting belt 43 and a discharge roll 44. In the sheet transporting system, after a sheet P stacked on the sheet tray 40 is transported by the transporting roll 41, the sheet P is temporarily stopped at the registration roll 42, and then transported to a secondary transfer position of the secondary transfer device 30 at a predetermined timing. Furthermore, in the sheet transporting system, the sheet P after the secondary transfer is transported through the transporting belt 43 to the fixing device 50, and the sheet P discharged from the fixing device 50 is transported to the outside of the apparatus by the discharge roll 44.

Here, the fixing device 50 heats and pressurizes the sheet P onto which a toner image is secondarily transferred, thereby fixing the toner image on the sheet P.

The image forming apparatus of this exemplary embodiment further includes a controller 100 for controlling the operation of each unit constituting the image forming apparatus, and an image processing unit 200 for processing image data input from the outside of the apparatus.

Next, the configuration of the developing unit 14 provided to each image forming unit 10 will be described.

First, the configuration of the developer used in the developing unit 14 will be described.

In this exemplary embodiment, so-called two-component developer containing magnetized carrier and toner colored with yellow, magenta, cyan or black.

The toner of this exemplary embodiment contains toner base particles formed of resin and coloring agent and additive. Toner can be manufactured according to a method of synthesizing toner through polymerization reaction such as emulsion polymerization, or suspension polymerization by using monomer, a method of fusing resin itself by heat and spraying the fused resin to atomize the resin, or a method of obtaining base particles having predetermined particle size through dispersion into water and mixing and fixing additive to the base particles by a Henschel mixer or the like.

As the resin contained in the toner may be used a single material or a mixture of two or more materials such as homopolymer of styrene and derivative substitution thereof such as polystyrene, polychlorostyrene, or polyvinyltoluene; styrene type copolymer such as copolymer of styrene/p-chlorostyrene, copolymer of styrene/propylene, copolymer of styrene/vinyl toluene, copolymer of styrene/vinyl naphthalane, copolymer of styrene/methyl acrylate, copolymer of styrene/ethyl acrylate, copoymer of styrene/butyl acrylate, copolymer of styrene/octyl arylate, copolymer of styrene/methyl metacrylate, copolymer of styrene/ethyl metacrylate, copolymer of styrene/butyl methacrylate, copolymer of styrene/methyl α-chlormethacrylate, copolymer of styrene/acrylonitrile, copolymer of styrene/vinyl methyl ether, copolymer of styrene/vinyl ethyl ether, copolymer of styrene/vinyl methyl ketone, copolymer of styrene/budadiene, copolymer of styrene/isoprene, copolymer of styrene/acrylonitrile/indene, copolymer of styrene/maleic acid, or copolymer of styrene/maleic ester, polymethylmetacrylate, polybutylmethacrlate, polyvinyl chloride, polyvinyl acetate, polyethylene, polypropylene, polyester, polyvinyl butyl butyral, polyacrylic acid resin, rosin, denatured rosin, terpene resin, phenol resin, aliphatic or alicyclic carbon hydride, aromatic type petroleum resin, chlorinated paraffin, paraffin wax or the like.

Furthermore, carbon black, aniline black, furnace black, lampblack or the like may be used as the coloring agent of black used for toner. Phthalocyanine blue, methylene blue, Victoria blue, methyl violet, aniline blue, ultramarine blue or the like may be used as the coloring agent of magenta. Rhodamine 6G rake, dimethyl quinacridone, watching red, rose bengal, rhodamine B, alizarin rake or the like may be used as the coloring agent of cyan. Chrome yellow, benzidine yellow, Hansa yellow, naphthol yellow, molybdenum orange, quinoline yellow, tartrazine or the like may be used as the coloring agent of yellow.

A small amount of charge adding agent (for example, dye or pigment material, polarity control agent) may be contained in these toner to efficiently charge the toner. As the polarity control agent may be used metal complex of monoazo dye, nitrohumic acid and salt thereof, metal complex of Co, Cr, Fe or the like of salicylic acid, naphthoic acid or dicarboxylic acid, organic dye, salt of quaternary ammonium or the like.

As inorganic fine particles used as the additive may be silica, alumina, titan oxide, barium titanate, magnesium titanate, calcium titanate, strontium titanate, iron oxide, copper oxide, zinc oxide, tin oxide, silica sand, clay, mica, silica ashstone, diatomaceous earth, chromium oxide, cerium oxide, bengala, antimony trioxide, magnesium oxide, zirconium oxide, barium sulfate, barium carbonate, calcium carbonate, silicon carbide, silicon nitride or the like. When two materials of silica and titan oxide in these materials are used, an effect of suppressing the additive from sinking into toner and an effect of stabilizing charging of toner can be particularly greatly enhanced.

The carrier of this exemplary embodiment is obtained by forming coating layers on magnetized core particles. The core particles of the carrier may be formed of ferromagnetic metal such as iron, cobalt, or nickel, alloy such as magnetite, hematite, ferrite, or compounds thereof.

As the resin for forming the coating layer of the carrier may be used polyolefin, for example, polyethylene, polypropylene, chlorinated polyethylene and chlorosulfonated polyethylene; polyvinyl and polyvinyliden type resin, for example, polystyrene, acrylic resin (for example, polymethyl methacrylate), polyacrylonitrile, polyvinyl acetate, polyvinyl alcohol, polyvinyl butyral, polyvinyl chloride, polyvinyl carbazole, polyvinyl ether and polyvinyl ketone; copolymer of vinyl chloride/vinyl acetate; copolymer of styrene/acrylic acid; silicon resin such as straight silicon resin formed of organosiloxane bond or denatured material thereof (for example, denatured material of alkyd resin, polyester, epoxy resin, polyurethane); fluorocarbon resin, for example, polytetrafluoroethylene, polyvinyl fluoride, polyvinylidene fluoride, polychlorotrifluoroethylene; polyimide; polyester, for example, polyethylene terephthalate; polyurethane; polycarbonate; amino resin, for example, urea/formaldehyde resin; epoxy resin or the like. Particularly, acrylic resin, silicon resin or denatured material thereof, fluorocarbon resin or the like (particularly, silicon resin or denatured material thereof) may be used as materials for preventing toner-spent. As the method of forming the coating layer, resin may be coated on the surfaces of carrier core particles by an atomizing method, a dipping method or the like.

Furthermore, in order to adjust the carrier resistance, etc., fine powder may be added to the coating layer. The fine powder dispersed in the coating layer is formed of particles of 0.01 to 5.0 μm. The fine powder may be added by 2 to 30 pts.wt. (particularly, 5 to 20 pts.wt.) with respect to 100 pts.wt. of the coating resin. Metal oxide such as silica, alumina, or titania, or pigment such as carbon black may be used as the fine powder.

Figure 2:
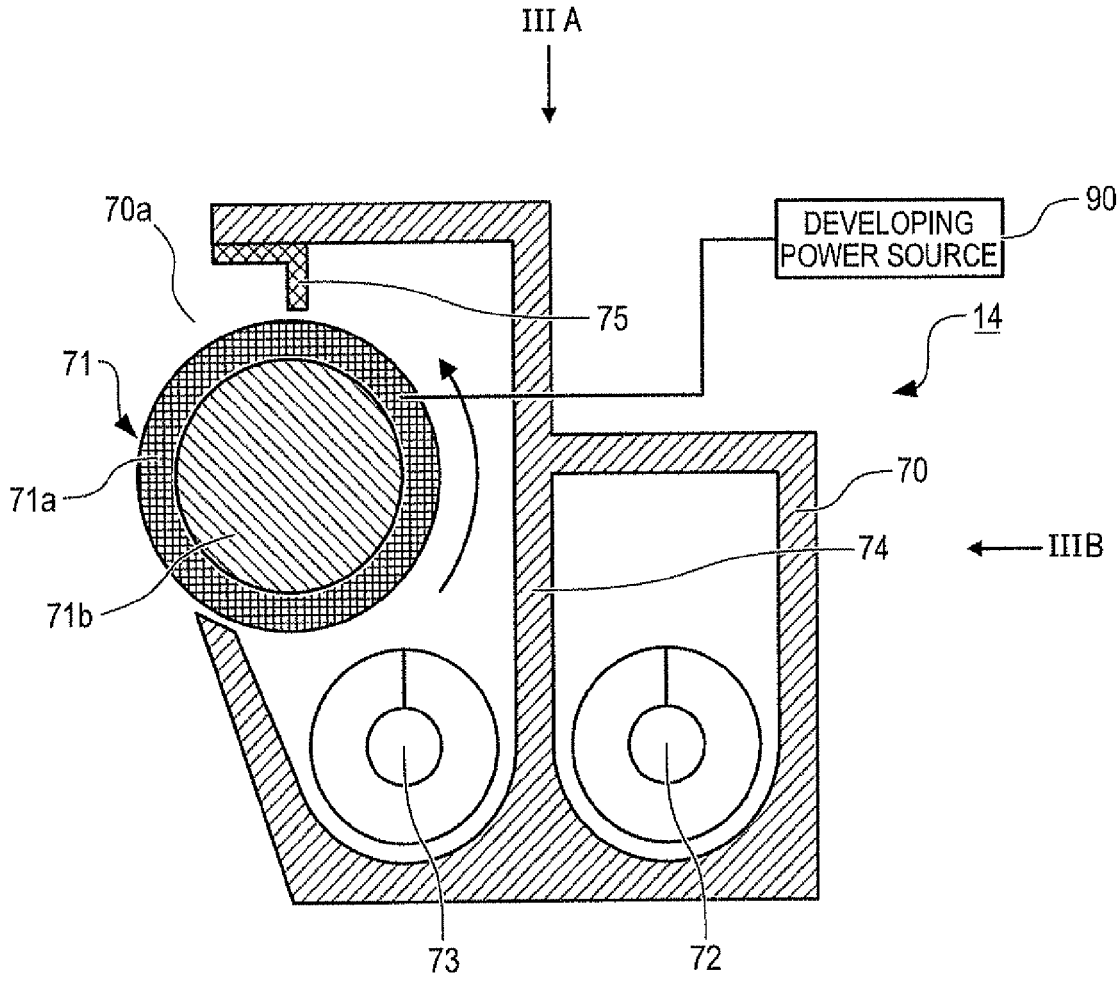
FIG. 2 is a side cross-sectional view of a developing unit.
Figure 3A:
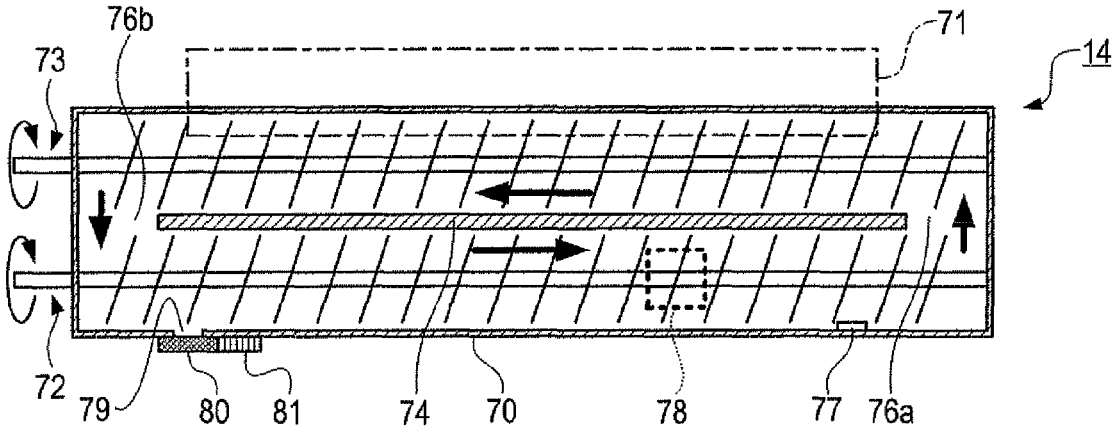
FIG. 3A is a top view of the developing unit when the developing unit of FIG. 2 is viewed from IIIA side.

FIG. 2 is a side cross-sectional view showing the developing unit 14, FIG. 3A is a top view of the developing unit 14 when the developing unit of FIG. 2 is viewed from IIIA side, and FIG. 35 is a back view of the developing unit 14 when the developing unit of FIG. 2 is viewed from IIIB side.

FIG. 3A shows a state that apart of a developing housing 70, a developing roll 71, a layer thickness regulating member 75, etc. are detached from the developing unit 14.

The developing unit 14 has the developing housing 70 as a developer container which has an opening portion 70*a* facing the photoconductive drum 11 and in which developer (not shown) containing toner and carrier (see FIG. 1) is accommodated, and the developing roll 71 as an example of the developer holder which is rotatably disposed so as to face the opening portion of the developing housing 70. A first stirring and carrying member 72 and a second stirring and carrying member 73 are disposed in the developing housing 70 and at the lower side of the backside of the developing roll 71 when viewed from the photoconductive drum 11 so that the first and second stirring and carrying members 72 and 73 are substantially in parallel to the axial direction of the photoconductive drum 11. In this exemplary embodiment, the first stirring and carrying member 72 is provided at a farther side from the developing roll 71, and the second stirring and carrying member 73 is provided at a nearer side to the developing roll 71. A, partition wall 74 through which the first and second stirring and carrying members 72 and 73 are insulated from each other is provided between the first and second stirring and carrying members 72 and 73. The partition wall 74 is formed integrally with the developing housing 70. A layer thickness regulating member 75 which is secured to the developing housing 70 and regulating the layer thickness of developer adhering to the developing roll 71 is provided to the upper side of the developing roll 71.

Here, the developing roll 71 has a developing sleeve 71*a* disposed rotatably, and a magnet roll 71*b* which is fixedly disposed inside the developing sleeve 71*a* and has plural magnet poles (not shown) arranged therein. The developing sleeve 71*a* is rotationally driven in a direction of an arrow by a motor (not shown), and it rotates in the same direction as the photoconductive drum 11 at the developing position facing the photoconductive drum 11 (see FIG. 1). For example, the developing sleeve 71*a* is made of metal such as SUS, and a developing power source 90 for applying a developing bias VB to the developing sleeve 71*a* is connected to the developing sleeve 71*a*. The developing bias VB is set to a value between the charging potential VH and the exposure potential VL as described later.

The first stirring and carrying member 72 has a rotational shaft and a blade which is spirally secured to the outer periphery of the rotational shaft, and it carries developer from the left side to the right side of FIG. 3A. The second stirring and carrying member 73 also has a rotational shaft and a blade which is spirally secured to the outer periphery of the rotational shaft, and it carries developer from the right side to the left side in FIG. 3A. The rotational shaft of the first stirring and carrying member 72 and the rotational shaft of the second stirring and carrying member 73 are rotatably mounted in the developing housing 70, and disposed so that one end portions thereof project to the outside from the developing housing 70. The first and second stirring and carrying members 72 and 73 are rotationally driven by a driving mechanism (not shown).

Furthermore, the partition wall 74 does not exist at both the inner end portions of the developing housing 70 in the axial direction, and thus a first delivery port 76*a* and a second delivery port 76*b* through which developer is delivered and received between the first and second stirring and carrying members 72 and 73 are provided at both the inner end portions. The first and second delivery ports 76*a* and 76*b* are located at outward positions with respect to both the end portions in the axial direction of the developing roll 71.

A magnetic sensor 77 as an example of a density detecting unit and a developer amount detecting unit used to detect the developer amount of developer in the developing housing 70 and detect the toner concentration of the developer in the developing housing 70 is mounted at a downstream side in a developer carrying direction of the first stirring and carrying member 72 and also at an upstream side in the developer carrying direction with respect to the first delivery port 76*a*.

Furthermore, a developer feed-in port 78 for feeding new developer from the outside into the developing housing 70 is provided at a site of the developing housing 70 which is located at an upstream side in the developer carrying direction of the first stirring and carrying member 72 with respect to the mount position of the magnetic sensor 77 and also at the upper side when viewed from the first stirring and carrying member 72.

A developer discharge port 79 for discharging to the outside surplus developer which becomes superfluous in the developing housing 70 due to replenishing of new developer is provided at a site of the developing housing 70 which is located at an upstream side in the developer carrying direction of the first stirring member 72 with respect to the formation position of the developer feed-in port 78 and also at a side when viewed from the first stirring and carrying member 72. The developer discharge port 79 is provided at the backside of the developing housing 70 when viewed from the developing roll 71, and the developing housing 70 is provided with an opening amount (aperture) varying member 80 which is moved in an up-and-down direction to change the opening amount (aperture) of the developer discharge port 79, and an opening driving unit 81 for driving the opening amount (aperture) varying member 80 in the up-and-down direction. In this exemplary embodiment, the developer discharge port 79, the opening amount varying member 80 and the opening driving unit 81 which are provided to the developing housing 70 function as an example of a discharge unit.

Figure 4:
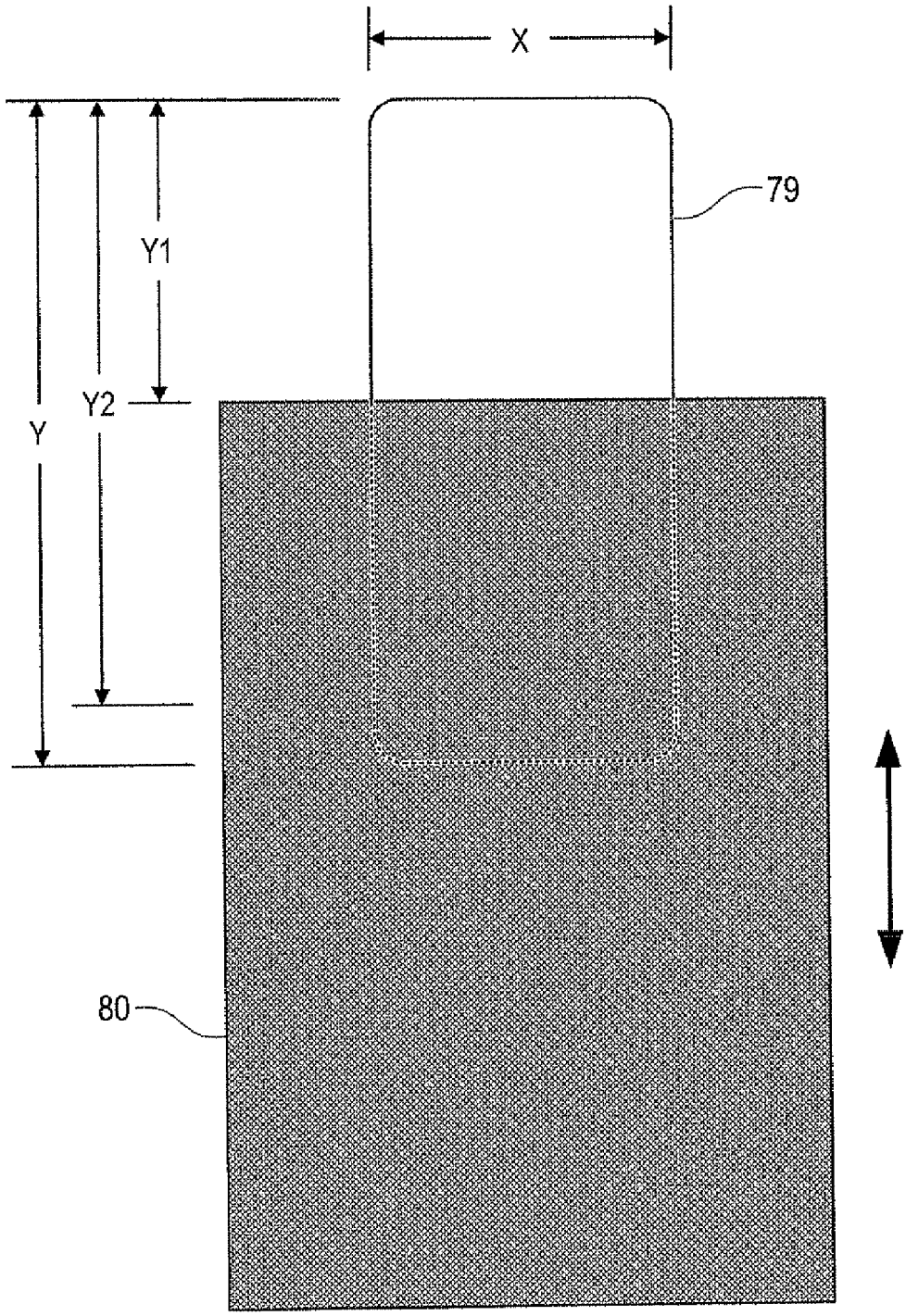
FIG. 4 is a diagram showing a positional relationship between a developer discharge port and an opening amount varying member.

FIG. 4 is a diagram showing the positional relationship between the developer discharge port 79 and the opening amount varying member 80 described above.

Figure 3B:
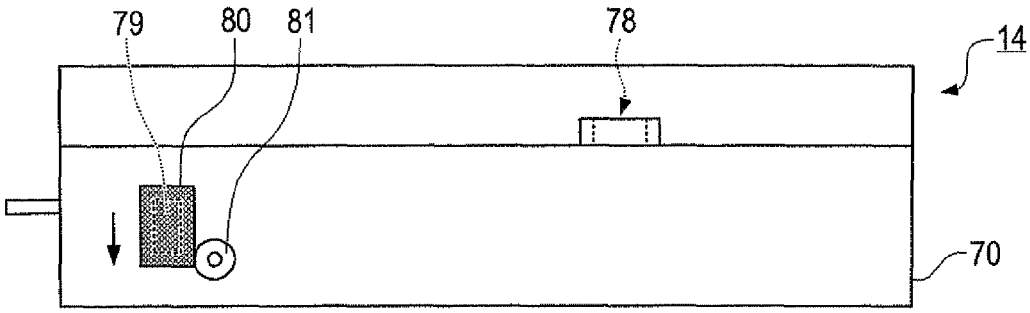
FIG. 3B is a back view of the developing unit when the developing unit of FIG. 2 is viewed from IIIB side.

When the lateral length of the developer discharge port 79 is represented by an opening width X and the longitudinal length of the developer discharge port 79 is represented by an opening height Y, the stop position of the opening amount varying member 80 is controlled by an opening driving unit 81 (see FIG. 3B) so that the developer discharge port 79 is set to a first opening height Y1 or a second opening height Y2 larger than the first opening height Y1. In this exemplary embodiment, the position of the opening amount varying member 80 is normally controlled by the opening driving unit 81 so that the opening portion formed by the developer discharge port 79 and the opening amount varying member 80 is equal to the first opening height Y1.

Figure 5:
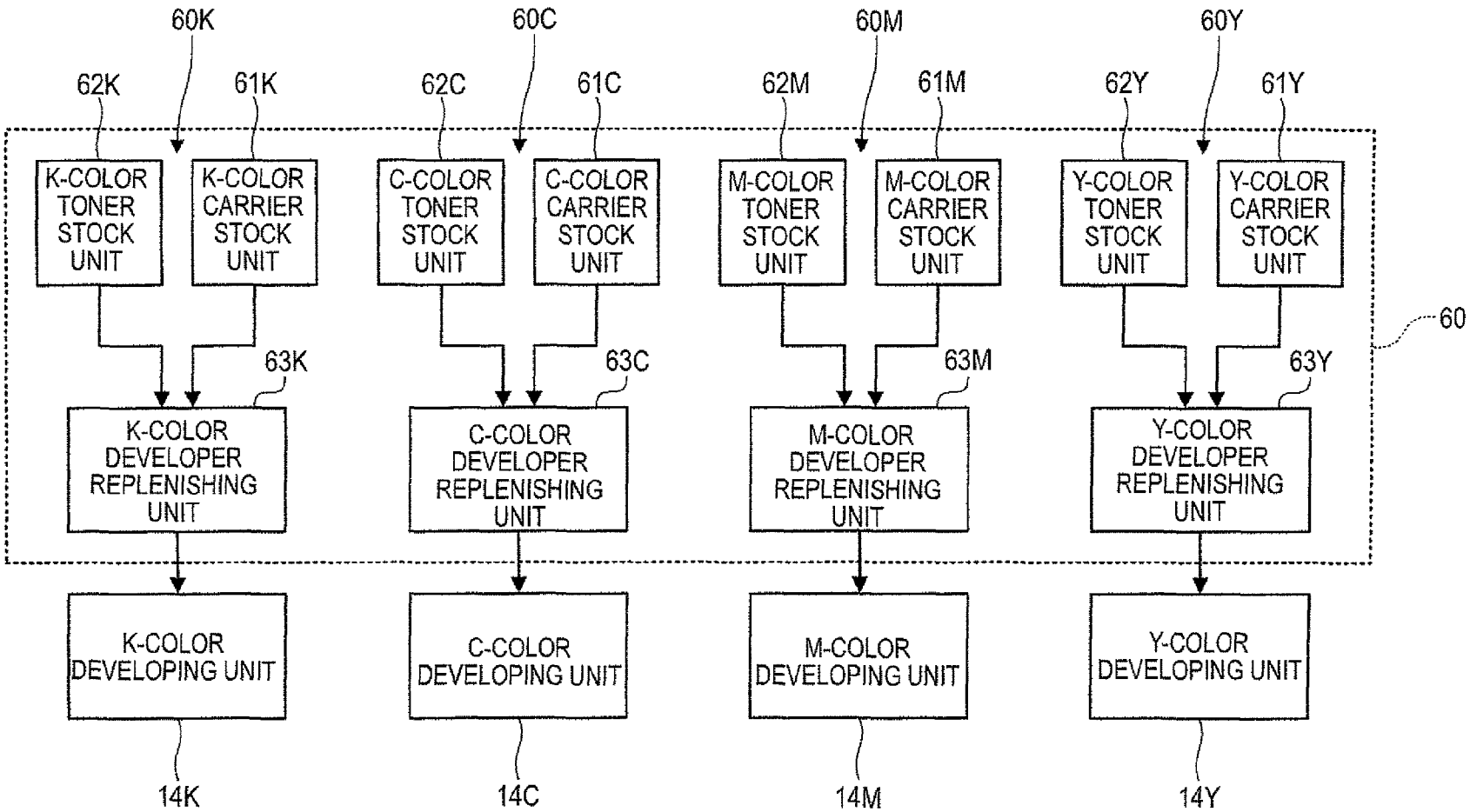
FIG. 5 is a diagram showing an example of the configuration of a developer replenishing mechanism.

FIG. 5 is a diagram showing an example of the configuration of a developer replenishing mechanism 60 for replenishing new developer to each of the developing units 14 (14Y, 14M, 14C, 14K) provided to the respective image forming units 10 shown in FIG. 1. The developer replenishing mechanism 60 as an example of a replenishing unit has a Y-color developer replenishing mechanism 60Y for replenishing new yellow developer to the Y-color developing unit 14Y, an M-color developer replenishing mechanism 60M for replenishing new magenta developer to the M-color developing unit 14M, a C-color developer replenishing mechanism 60C for replenishing new cyan developer to the C-color developing unit 14C, and a K-color developer replenishing mechanism 60K for replenishing new black developer to the K-color developing unit 14K.

The Y-color developer replenishing mechanism 60Y has a Y-color carrier stock unit 61Y for stocking carrier for yellow, a Y-color toner stock unit 62Y for stocking toner of yellow, and a Y-color developer replenishing unit 63Y for taking out from the Y-color carrier stock unit 61Y the Y-color carrier whose amount is determined according to the procedure described later, taking out from the Y-color toner stock unit 62Y the Y-color toner whose amount is determined according to the procedure described later, and replenishing new yellow developer containing the take-out Y-color carrier and Y-color toner to the yellow developing unit 14Y.

The M-color developer replenishing mechanism 60M has a M-color carrier stock unit 61M for stocking carrier for magenta, a M-color toner stock unit 62M for stocking toner of magenta, and a M-color developer replenishing unit 63M for taking out from the M-color carrier stock unit 61M the M-color carrier whose amount is determined according to the procedure described later, taking out from the M-color toner stock unit 62M the M-color toner whose amount is determined according to the procedure described later, and replenishing new magenta developer containing the take-out M-color carrier and M-color toner to the magenta developing unit 14M.

The C-color developer replenishing mechanism 60C has a C-color carrier stock unit 61C for stocking carrier for cyan, a C-color toner stock unit 62C for stocking toner of cyan, and a C-color developer replenishing unit 63C for taking out from the C-color carrier stock unit 61C the C-color carrier whose amount is determined according to the procedure described later, taking out from the C-color toner stock unit 62C the C-color toner whose amount is determined according to the procedure described later, and replenishing new cyan developer containing the take-out C-color carrier and C-color toner to the cyan developing unit 14C.

Furthermore, the K-color developer replenishing mechanism 60K has a K-color carrier stock unit 61K for stocking carrier for black, a K-color toner stock unit 62K for stocking toner of black, and a K-color developer replenishing unit 63K for taking out from the K-color carrier stock unit 61K the K-color carrier whose amount is determined according to the procedure described later, taking out from the K-color toner stock unit 62K the K-color toner whose amount is determined according to the procedure described later, and replenishing new black developer containing the take-out K-color carrier and K-color toner to the black developing unit 14K.

In this example, the Y-color carrier stock unit 61Y, the M-color carrier stock unit 61M, the C-color carrier stock unit 61C and the K-color carrier stock unit 61K are provided separately from one another. However, the carrier itself can be used irrespective of the toner color, and thus a common carrier stock unit may be provided in place of the individual carrier stock units.

Figure 6:
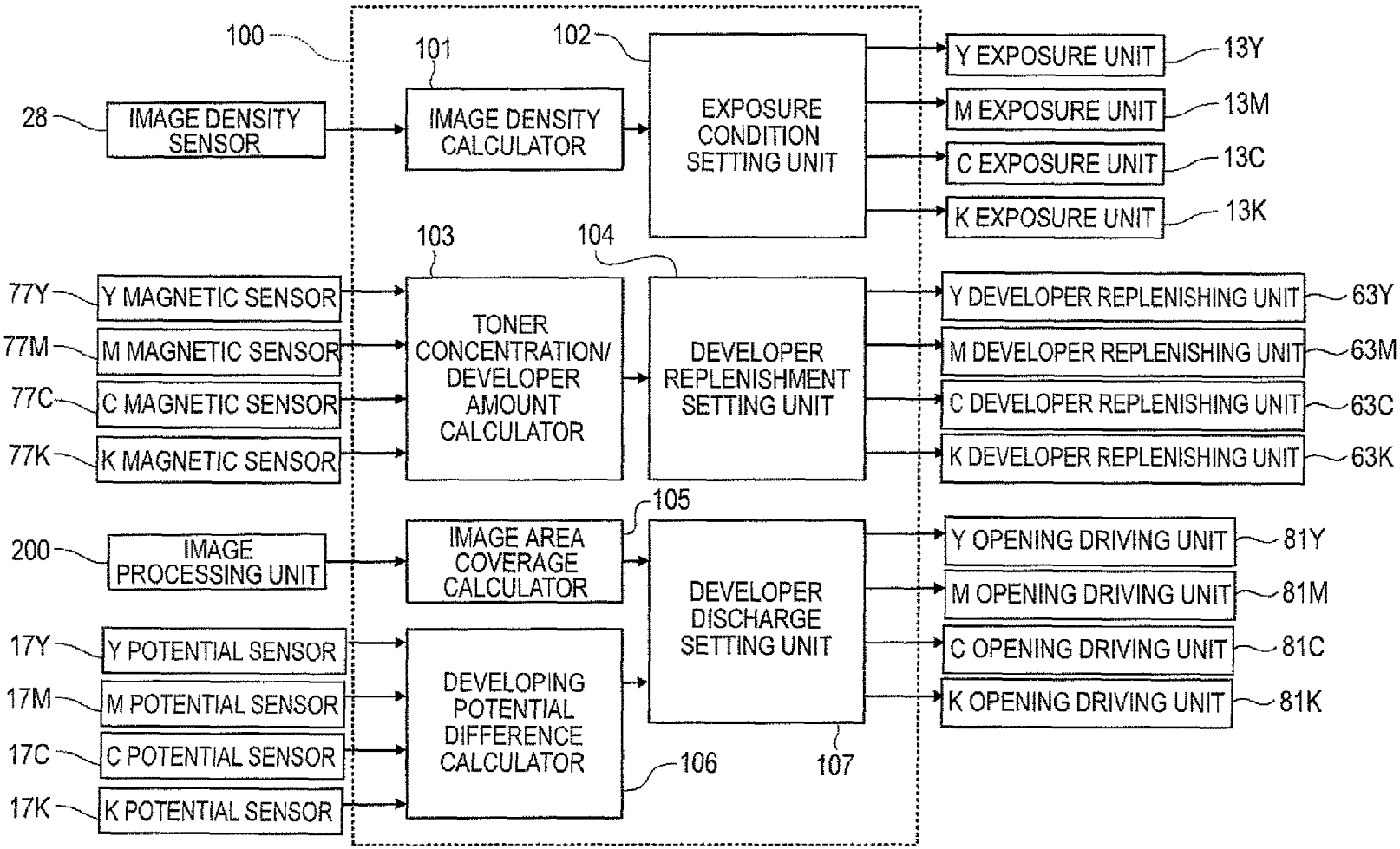
FIG. 6 is a block diagram showing an example of the configuration of a controller.

FIG. 6 is a block diagram showing an example of the configuration of the controller 100 shown in FIG. 1. The controller 100 controls the operation of the respective parts constituting the image forming apparatus as described above, and the units associated with the developer replenishing to the developing unit 14 provided to each image forming unit 10 and the developer discharge from the developing unit 14 are picked up and illustrated in FIG. 6.

The controller 100 includes an image density calculator 101 for calculating the density of an image quality adjusting image of each color of YMCK on the basis of an image read-out result obtained by reading out the image quality adjusting image of each color of YMCK which is formed in each image forming unit 10 and primarily transferred to the intermediate transfer belt 20 (see FIG. 1), and an exposure condition setting unit 102 for setting an exposure condition (for example, exposed light intensity) in the exposure unit 13 (13Y, 13M, 13C, 13K) of each image forming unit 10 on the basis of the calculation result of the density of the image of each color obtained by the image density calculator 101.

Furthermore, the controller 100 has a toner concentration/developer amount calculator 103 for calculating toner concentration TC of developer in the developing housing 70 of each developing unit 14 and a developer amount Q in the developing housing 70 on the basis of a detection result of the magnetic sensor 77 (77Y, 77M, 77C, 77K) provided to the developing unit 14 (14Y, 14M, 14C, 14K) of each image forming unit 10, and a developer replenishing setting unit 104 as an example of a setting unit for setting replenishing of new developer to each developing unit 14 on the basis of the toner concentration TC and the developer amount Q in each developing unit 14 by the toner concentration/developer amount calculator 103.

The controller 100 has an image area coverage calculator 105 as an example of a calculating unit for calculating an image area coverage of each color image on the basis of an exposure signal of each color of YMCK input from the image processing unit 200 (see FIG. 1) in an image forming operation executed on a sheet P, a developing potential difference calculator 106 as an example of an obtaining unit for calculating a developing potential difference VD (potential difference) corresponding to the difference between an exposure potential VL and a developing bias VB in each image forming unit 10 on the basis of a detection result of the potential sensor 17 (17Y, 17M, 17C, 17K) provided to each image forming unit 10, and a developer discharge setting unit 107 as an example of a control unit for setting discharge of developer from each developing unit 14 by controlling the driving of the opening driving unit 81 (81Y, 81M, 81C, 81K) provided to each developing unit 14 on the basis of the image area coverage AC of each color image obtained by the image area coverage calculator 105 and the developing potential difference VD of each color obtained by the developing potential difference calculator 106.

Here, the image area coverage AC determined in the image area coverage calculator 105 represents the ratio of the area of a toner-adhering portion to the total area of one surface of one sheet P. Accordingly, as the image area coverage AC increases, the amount of toner required to develop an image of one sheet increases. Furthermore, the image area coverage AC is required to be determined every color of YMCK for an image of one sheet. Accordingly, for example when a monochromatic image of black is formed on a sheet P, the image area coverage AC of each of YMC is equal to zero, and the image area coverage AC of K is equal to a positive value other than zero.

Next, the developing potential difference VD determined in the developing potential difference calculator 106 will be described.

Figure 7:
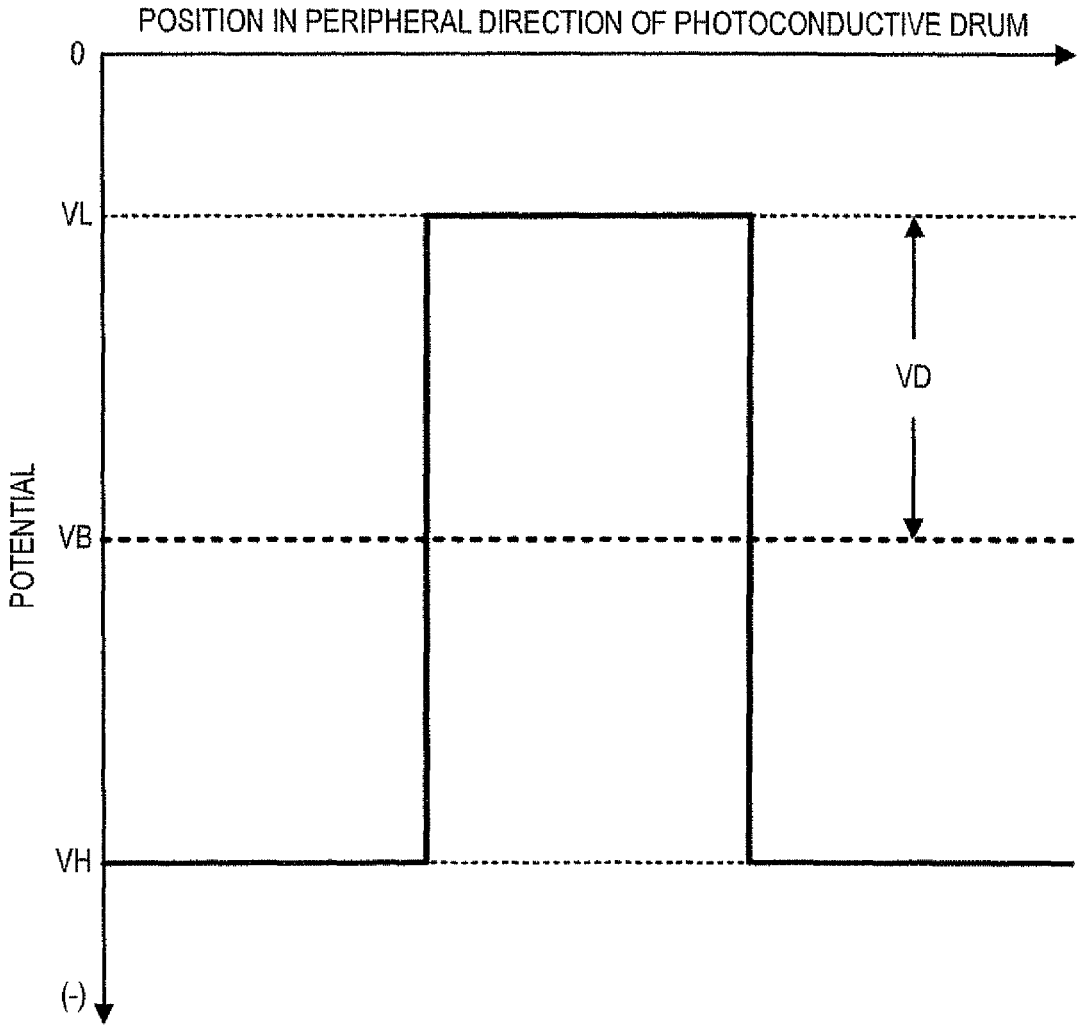
FIG. 7 is a diagram showing a relationship of charging potential, exposure potential, developing bias and developing potential difference.

FIG. 7 is a diagram showing the relationship of the charging potential VH obtained by charging the photoconductive layer of the photoconductive drum 11, the exposure potential VL obtained by exposing the charged photoconductive layer to light, the developing bias VB applied to the developing sleeve 71*a* and the developing potential difference VD corresponding to the difference between the exposure potential VL and the developing bias VB. In FIG. 7, the abscissa axis represents the position in the peripheral direction of the photoconductive drum 11, and the ordinate axis represents the potential of the photoconductive layer at each position in the peripheral direction.

Here, the developing bias VB is a DC voltage having a negative polarity whose absolute value is smaller than the charging potential VH and larger than the exposure potential VL, and it is supplied by the developing power source 90 (see FIG. 2). Accordingly, developing electric field is formed between the developing sleeve 71*a* of the developing roll 71 and the grounded photoconductive drum 11 by the applied developing bias VB. Here, an area at the charging potential. VH on the photoconductive drum 11 has a negative potential relatively with respect to the developing bias VB. Therefore, the toner (negatively charged) on the developing sleeve 71*a* does not transfer onto this area, and thus this area becomes a background portion. On the other hand, an area at the exposure potential VL on the photoconductive drum 11 has a positive potential relatively with respect to the developing bias VB, and thus the toner (negatively charged) on the developing sleeve 71*a* electrostatically transfers and adheres to this area. Therefore, this area becomes an image area. That is, in this exemplary embodiment, the development is performed by an inverse developing system. The developing potential difference VD is represented by the potential difference between the developing bias VB as the potential of the developing sleeve 71*a* and the exposure potential VL as the image portion on the photoconductive drum 11. An AC voltage may be further superposed on the developing bias VB as occasion demands.

Next, an image forming process of the image forming apparatus will be described.

Upon input of image data for forming an image on a sheet P from the outside, the image processing unit 200 subjects this image data to image processing to create exposure signals corresponding to yellow, magenta, cyan and black, and outputs the created exposure signals to the exposure units 13 of the respective image forming units 10. The controller 100 starts the operation of each unit constituting the image forming apparatus.

Subsequently, in each image forming unit 10, the photoconductive drum 11 which is uniformly charged by the charging roll 12 is irradiated with the beam corresponding to the exposure signal by the exposure unit 13 to form an electrostatic latent image. The electrostatic latent image formed on the photoconductive drum 11 is developed by the developing unit 14 to form a toner image of each color. Thereafter, the toner images formed on the respective photoconductive drums 11 are successively primarily transferred onto the surface of the intermediate transfer belt 20 by the primary transfer roll 15 at the primary transfer position at which the photoconductive drum 11 and the intermediate transfer belt 20 come into contact with each other. Toner remaining on the photoconductive drum 11 after the primary transfer is cleaned by the drum cleaner 16.

As described above, the toner images of respective colors which are primarily transferred onto the intermediate transfer belt 20 are superposed on the intermediate transfer belt 20, and carried to the secondary transfer position together with the rotation of the intermediate transfer belt 20. Furthermore, a sheet P is transported to the secondary transfer position at a predetermined timing, and the secondary transfer roll 31 nips the sheet P together with the backup roll 25.

At the secondary transfer position, the toner image held on the intermediate transfer belt 20 is secondarily transferred onto the sheet P by the action of transfer electric field formed between the secondary transfer roll 31 and the backup roll 25. The sheet P having the toner image transferred thereto is transported to the fixing device 50 by the transporting belt 43. In the fixing device 50, the toner image on the sheet P is heated and pressurized to be fixed, and then fed out to a sheet discharge tray (not shown) provided at the outside of the apparatus. Toner remaining on the intermediate transfer belt 20 after the secondary transfer is cleaned by the belt cleaner 27.

The basic operation of the developing unit 14 in the image forming operation will be described.

In the developing unit 14, the developing sleeve 71*a*, the first stirring and carrying member 72 and the second stirring and carrying member 73 are rotationally driven by a motor (not shown). At this time, in the developing housing 70, the developer is stirred and carried by the first and second stirring and carrying members 72 and 73 while circulated. Accordingly, toner is negatively charged by frictional electrification between the toner and the carrier, and the carrier is positively charged. Therefore, the toner electrostatically adheres to the carrier together with stirring and carrying. When the stirred and carried developer passes through the developing roll 71 side, a part of the developer transfers and adheres onto the developing sleeve 71*a* to form a developer layer by magnetic force of a magnetic pole (not shown) provided to the magnet roll 71*b*. When the developer layer formed on the developing sleeve 71*a* passes over the confront portion to the layer thickness regulating member 75 together with the rotation of the developing sleeve 71*a*, the layer thickness of the developer layer formed on the developing sleeve 71*a* is regulated in accordance with the gap formed between the developing sleeve 71*a* and the layer thickness regulating member 75, and the developer layer is carried to the developing area facing the photosensitive drum 11.

At this time, the developing bias VB is applied to the developing sleeve 71*a* by the developing power source 90. Therefore, in the developing area, the toner on the developing sleeve 71*a* does not transfer to the site kept at the charging potential VH on the photoconductive drum 11, but selectively transfers to the site kept at the exposure potential on the conductive drum 11. The developer which has been passed through the developing area and thus is reduced by the toner amount corresponding to the toner used for the development is further carried together with the rotation of the developing sleeve 71*a*, exfoliated from the developing sleeve 71*a* by repulsive magnetic field caused by the magnetic pole having the same polarity which is adjacently provided in the magnetic roll 71*b* and then waits for the next development while stirred and carried by the first and second stirring and carrying members 72 and 73 again.

In the image forming apparatus, the toner constituting the developer accommodated in each developing unit 14 is used for the development, so that the toner concentration TC of the developer is gradually reduced. The carrier constituting the developer in each developing unit 14 is not basically discharged to the outside unlike the toner, so that the characteristic thereof (particularly, the charging performance of the toner) is gradually deteriorated as it is used for a long term. Therefore, in this exemplary embodiment, the toner concentration TC of the developer in each developing unit 14 is detected, and when the toner concentration TC is lowered, new developer containing toner and carrier is supplied to each developing unit 14 by using the developer replenishing mechanism 60. The developer which is superfluous in each developing unit 14 as a result of the supply of new developer to each developing unit 14 as described above is discharged as wasted developer through each developer discharge port 79. As described above, in each developing unit 14, replenishment of toner whose amount is reduced due to the development and removal of carrier which is deteriorated due to long-term use are performed interlockingly with each other.

Furthermore, in this exemplary embodiment, in addition the normal interchange of developer described above, the amount of developer discharged from each developing unit 14 is increased under such a condition that toner which is not used for the development can be circulated and carried in each developing unit 14 over a long term. In this exemplary embodiment, the developer amount Q in each developing unit 14 is detected, and when the developer amount Q decreases, new developer containing toner and carrier is supplied to each developing unit 14 by using the developer replenishing mechanism 60. As described above, the removal of toner and carrier which are deteriorated due to long-term stirring and carrying and the replenishment of new toner and carrier are performed interlockingly with each other in each developing unit 14.

Figure 8:
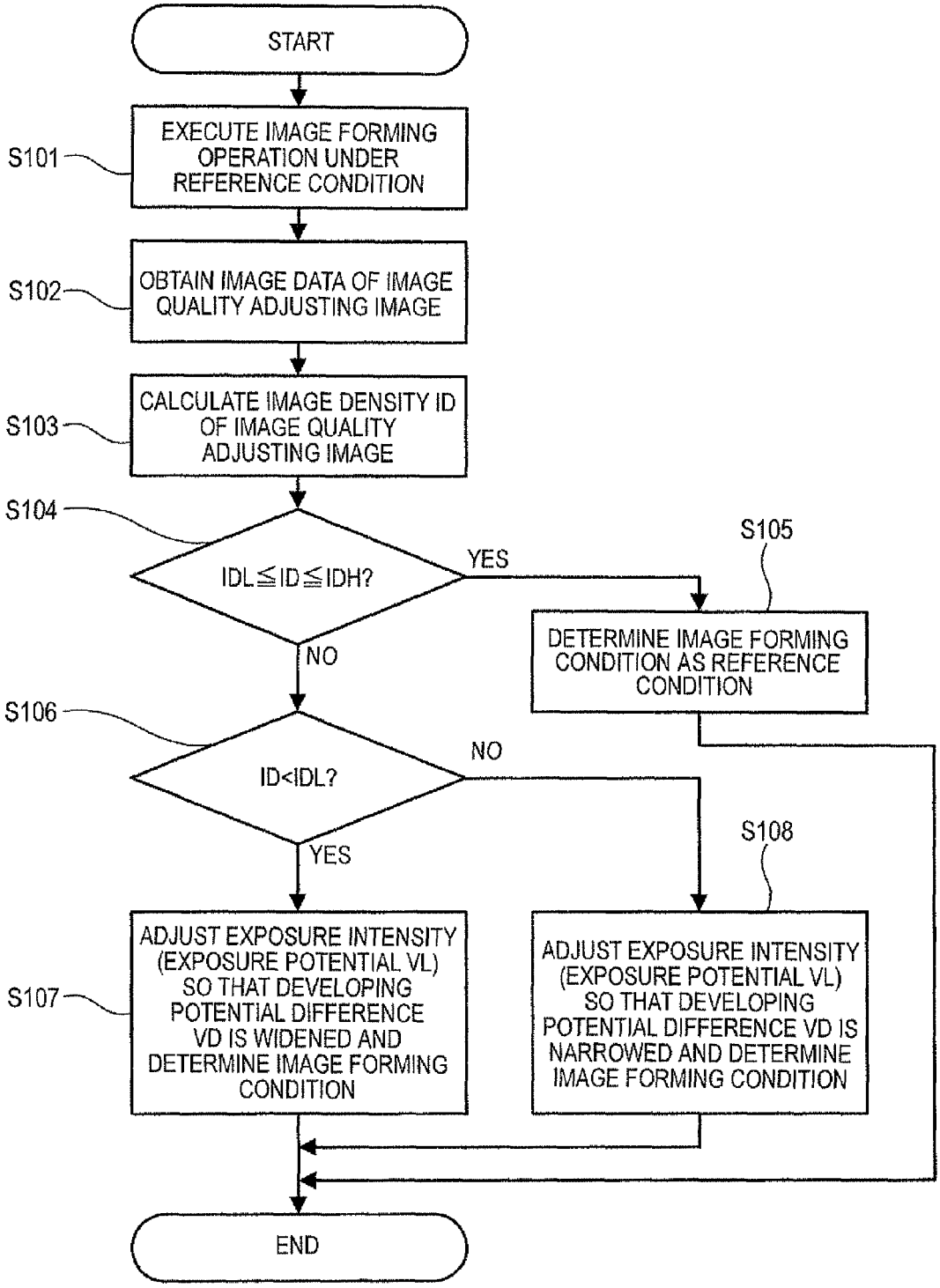
FIG. 8 is a flowchart showing an example of a control procedure of setting an image forming condition executed before an image forming operation of the image forming apparatus.

FIG. 8 is a flowchart showing an example of the procedure of controlling the setting of the image forming condition which is executed before the image forming operation of the image forming apparatus is executed. The procedure shown in FIG. 8 is executed after the image forming apparatus is powered on and before the first image forming operation is started, and after some image forming operation is finished and before the next image forming operation is started.

The procedure shown in FIG. 8 is executed at the frequency corresponding to the number of the image forming units 10 (in this case, four) provided to the image forming apparatus. In the following description, the control of setting the image forming condition in the yellow image forming unit 10Y will be representatively described. The control of setting the image forming condition is executed according to the same procedure in the image forming units 10M, 10C, 10K of magenta, cyan and black.

First, the controller 100 controls the respective parts constituting the image forming apparatus, and executes the image forming operation under a reference condition (step 101). Here, the reference condition is an image forming condition which is preset to form an image having a target image density (for example, 50% density). In connection with this operation, in the yellow image forming unit 10Y, the charging roll 12 charges the photoconductive drum 11 under a reference charging condition, the exposure unit 13 exposes the photoconductive drum 11 to light under a reference exposure condition, and the developing unit 14 develops an electrostatic latent image on the photoconductive drum 11 with toner under a reference developing condition, thereby forming an image quality adjusting image of yellow on the photoconductive drum 11. The image quality adjusting image of yellow formed in the yellow image forming unit 10Y is primarily transferred to the intermediate transfer belt 20, and then read out by the image density sensor 28. The yellow image quality adjusting image which is primarily transferred to the intermediate transfer belt 20 is removed by the belt cleaner 27 without being secondarily transferred to a sheet P.

Subsequently, the image density calculator 101 provided to the controller 100 obtains image data of the yellow image quality adjusting image read out by the image density sensor 28 (step 102), and calculates the image density ID of the yellow image quality adjusting image on the basis of the image data (step 103).

Subsequently, the exposure condition setting unit 102 reads out a permissible lower limit value IDL and a permissible upper limit value IDH for yellow which are stored in a memory (not shown). The permissible lower limit value IDL and the permissible upper limit value IDH are preset as a permissible range of the density of an image to be actually formed with respect to the target image density (in this case, 50% density). The exposure condition setting unit 102 determines whether the image density ID of the yellow image quality adjusting image input from the image density calculator 101 ranges from the permissible lower limit IDL to the permissible upper limit value IDH (step 104).

When the determination in step 104 is positive (Y), the exposure condition setting unit 102 determines the image forming condition for actual image formation as the reference condition used in step 101 (step 105), and then finishes a series of processing.

On the other hand, when the determination in step 104 is negative (N), the exposure condition setting unit 102 determines whether the image density ID of the yellow image quality adjusting image is less than the permissible lower limit value IDL or not (step 106).

When the determination in step 106 is positive (Y), the exposure condition setting unit 102 sets, as the image forming condition for actual image formation, a result obtained by adjusting the exposure intensity, that is, the exposure potential VL so that the developing potential difference VD is widened with respect to the reference condition used in step 101 (the exposure potential VL is distanced from the developing bias VB) (step 107), and then finishes the series of processing.

On the other hand, when the determination in step 106 is negative (N), that is, when it is determined that the image density ID of the yellow image quality adjusting image exceeds the permissible upper limit value IDH, the exposure condition setting unit 102 sets, as the image forming condition for actual image formation, a result obtained by adjusting the exposure intensity, that is, the exposure potential VL so that the developing potential difference VD is narrowed with respect to the reference condition used in step 101 (the exposure potential VL is approached to the developing bias VB) (step S108), and then finishes the series of processing.

In this case, the exposure potential VL is varied to adjust the developing potential difference VD. However, this exemplary embodiment is not limited to this configuration, but the developing bias VB may be changed. Also, both the exposure potential VL and the developing bias VB may be varied. However, it is assumed in this exemplary embodiment that the developing bias VB is set to a fixed value and the exposure potential VL is set to a variable value to adjust the developing potential difference VD.

Figure 9:
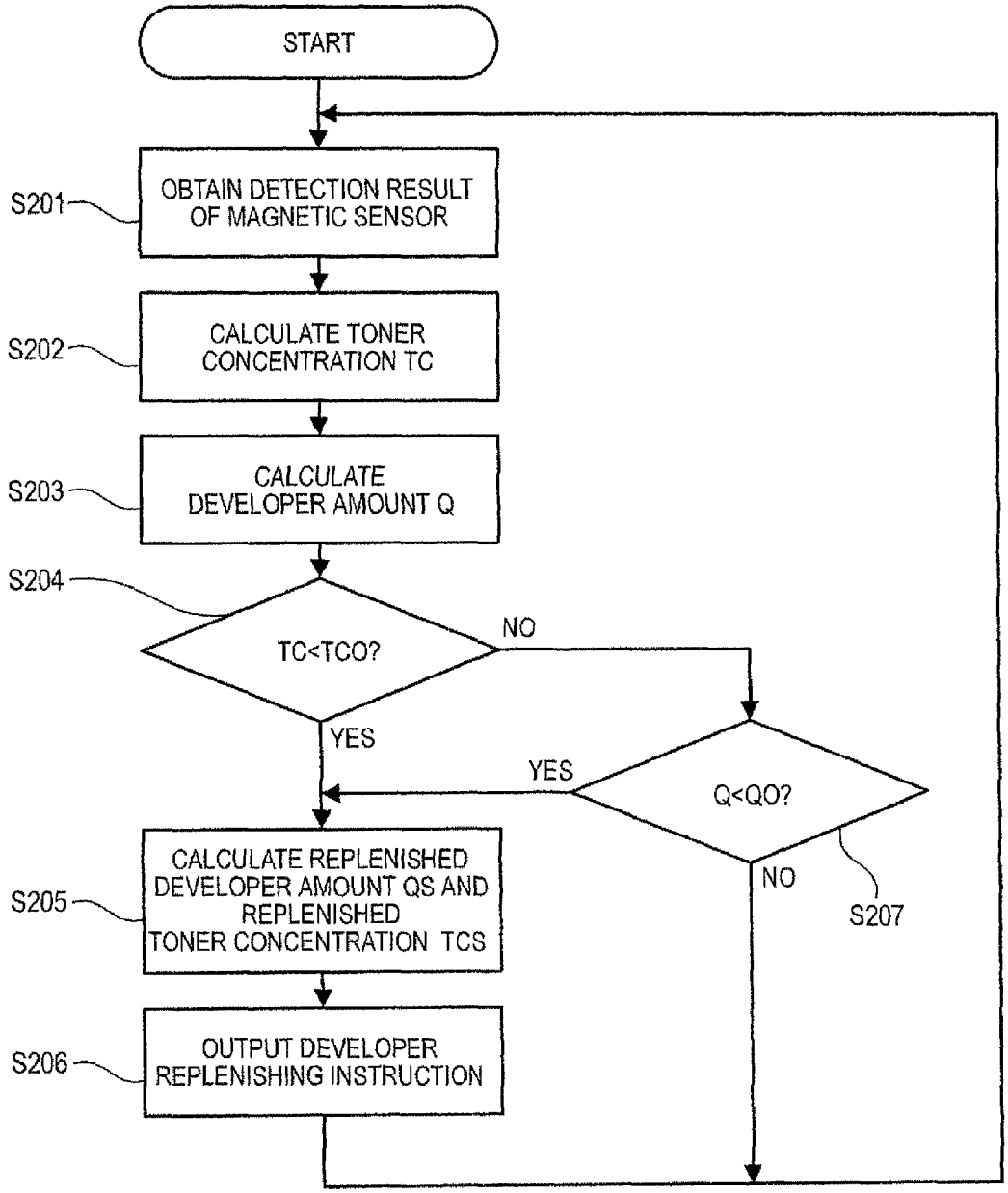
FIG. 9 is a flowchart showing an example of a control procedure of replenishing new developer to the developing unit in an actual image forming operation.

FIG. 9 is a flowchart showing an example of the procedure of controlling replenishment of new developer to the developing unit 14. Here, the procedure shown in FIG. 9 is executed at all times during the period when the developer in the developing unit 14 is stirred and carried in the image forming apparatus, for example.

Furthermore, the procedure shown in FIG. 9 is executed at the frequency corresponding to only the number of the image forming units 10 (four in this case) provided to the image forming apparatus, and in the following description, the control of replenishing developer for the yellow developing unit 14Y provided to the yellow image forming unit 10Y will be representatively described. The replenishing control of developer is executed according to the same procedure in the image forming units 10M, 10C, 10K of magenta, cyan and black.

First, the toner concentration/developer amount calculator 103 provided to the controller 100 obtains a detection result of the yellow magnetic sensor 77Y (step 201), and calculates the toner concentration TC of yellow toner of developer in the yellow developing unit 14Y on the basis of the detection result (step 202). Subsequently, the toner concentration/developer amount calculator 103 calculates the developer amount Q in the yellow developing unit 14Y on the basis of the detection result obtained in step 201 (step 203).

Subsequently, the toner concentration/developer amount calculator 103 reads out a reference toner concentration TC0 of yellow stored in a memory (not shown). The reference toner concentration TC0 corresponds to the permissible lower limit value of the toner concentration TC of the developer in the yellow developing unit 14Y, and it is preset. The toner concentration/developer amount calculator 103 determines whether the toner concentration TC obtained in step 202 is less than the reference toner concentration TC0 (step 204).

When the determination in step 204 is positive (Y), the developer replenishing setting unit 104 calculates the replenished developer amount QS of new developer to be replenished to the yellow developing unit 14Y and the replenished toner concentration TCS in the new developer on the basis of the toner concentration TC obtained in step 202 and the developer amount Q obtained in step 203 (step 205). The developer replenishing setting unit 104 outputs a developer replenishing instruction containing the obtained replenished developer amount QS and replenished toner concentration TCS to the Y-color developer replenishing unit 63Y (step 206), and returns to the step 201 to continue the processing.

On the other hand, when the determination in step 204 is negative (N), the toner concentration/developer amount calculator 103 reads out a yellow reference developer amount Q0 stored in the memory (not shown). The reference developer amount Q0 corresponds to the permissible lower limit value of the developer amount Q of developer in the yellow developing unit 14Y, and it is preset. The toner concentration/developer amount calculator 103 determines whether developer amount Q obtained in step 203 is less than the reference developer amount Q0 (step 207).

When the determination in step 207 is positive (Y), the developer replenishing setting unit 104 calculates the replenished developer amount QS of new developer to be replenished to the yellow developing unit 14Y and the replenished toner concentration TCS in the new developer on the basis of the toner concentration TC obtained in step 202 and the developer amount Q obtained in step 203 (step 5). The developer replenishing setting unit 104 outputs a developer replenishing instruction containing the obtained replenished developer amount QS and replenished toner concentration TCS to the Y-color developer replenishing unit 63Y (step 206), and then returns to the step S201 to continue the processing.

On the other hand, when the determination in step 207 is negative (N), the developer replenishing setting unit 104 returns to the step 201 to continue the processing without outputting any replenishing instruction of new developer.

When the developer replenishing instruction is output in step 206, the Y-color developer replenishing unit 63Y takes out, from the Y-color carrier stock unit 61Y and the Y-color toner stock unit 62Y, carrier and toner whose amounts correspond to the replenished developer amount QS and the replenished toner concentration TCS, and supplies the carrier and the toner through the developer feed-in port 78 to the yellow developing unit 14Y.

Figure 10:
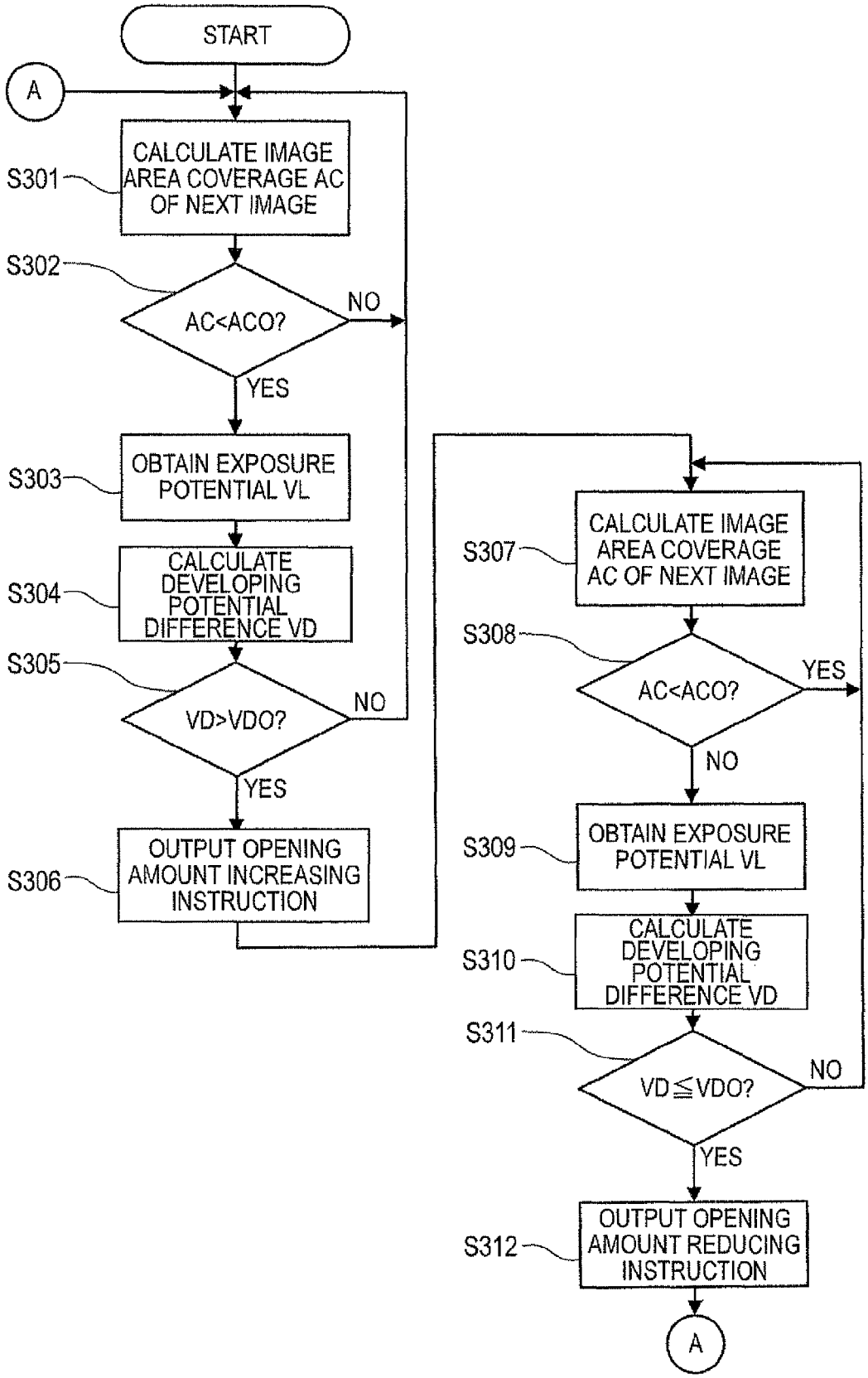
FIG. 10 is a flowchart showing an example of a control procedure of discharging developer in the developing unit in the actual image forming operation.

FIG. 10 is a flowchart showing an example of the procedure of controlling the discharge of developer in the developing unit 14. Here, the procedure shown in FIG. 10 is executed every time the image forming operation is executed on a sheet P in the image forming apparatus, for example. The procedure shown in FIG. 10 is executed in parallel to the developer replenishing control shown in FIG. 9. Under the initial state, it is assumed that the opening portion of the developer feed-out port 79 provided to the yellow developing unit 14Y is set to the first opening height Y1.

The procedure shown in FIG. 10 is executed at the frequency corresponding to the number of the image forming units 10 (four in this example) provided to the image forming apparatus. In the following description, the discharge control of the yellow developing unit 14Y provided to the yellow image forming unit 10Y will be representatively described. The discharge control of developer is executed according to the same procedure in the image forming units 10M, 10C, 10K of magenta, cyan and black.

The image area coverage calculator 105 provided to the controller 100 calculates a yellow image area coverage AC of a next image on the basis of an exposure signal of a yellow image of a next one sheet which is obtained as a processing result of the image processing unit 200 (step 301).

Subsequently, the image area coverage calculator 105 reads out a yellow reference image area coverage AC0 stored in the memory (not shown). This reference image coverage AC0 corresponds to a threshold value for determining whether the discharge amount of developer should be increased or not, and is preset. The image area coverage calculator 105 determines whether the image area coverage AC obtained in step 301 is less than the reference image area coverage AC0 or not (step 302).

When the determination in step 302 is positive (Y), the developing potential difference calculator 106 obtains a measurement result of the exposure potential VL by the yellow potential sensor 17Y (step 303). The developing potential difference calculator 106 calculates the difference between the exposure potential VL obtained in step 303 and the developing bias VB set as a fixed value, that is, the developing potential difference VD (step 304).

Subsequently, the developing potential difference calculator 106 reads out a yellow reference developing potential difference VD0 (reference potential difference) stored in the memory (not shown). This reference developing potential difference VD0 corresponds to a threshold value for determining whether the developer in the Y-color developing unit 14Y is deteriorated due to stagnation or not, and it is preset. The developing potential difference calculator 106 determines whether the developing potential difference VD obtained in step 304 exceeds the reference developing potential difference VD0 or not (step 305).

When the determination in step 305 is positive (Y), the developer discharge setting unit 107 outputs an opening amount increasing instruction of moving the opening amount varying member 80 to the opening driving unit 81Y provided to the yellow developing unit 14Y so that the opening portion of the developer discharge port 79 increases from the opening height Y1 to the second opening height Y2 (step 306), thereby changing the opening portion to the second opening height Y2, and then goes to the next step 307.

When the determination in step 305 is negative (N), and when the determination in step 302 is negative (N), the developer discharge setting unit 107 keeps the opening portion to the first opening height Y1, and returns to the step 301 to continue the processing.

Furthermore, when the opening amount increasing instruction is output in step 306, the image area coverage calculator 105 calculates the yellow image area coverage AC of a next image on the basis of the exposure signal of a yellow image of next one sheet which is obtained as a processing result of the image processing unit 200 (step 307).

Subsequently, the image area coverage calculator 105 reads out the yellow reference image area coverage AC0 from the memory (not shown), and determines whether the image area coverage AC obtained in step 307 is less than the reference image area coverage AC0 (step 308).

When the determination in step 308 is negative (N), the developing potential difference calculator 106 obtains a measurement result of the exposure potential VL by the yellow potential sensor 17Y (step 309). The developing potential difference calculator 106 calculates the difference between the exposure potential VL obtained in step 309 and the developing bias VB set as a fixed value, that is, the developing potential difference VD (step 310).

Subsequently, the developing potential difference calculator 106 reads out the yellow reference developing potential difference VD0 from the memory (not shown), and determines whether the developing potential difference VD obtained in step 310 is not more than the reference developing potential difference VD0 or not (step 311).

When the determination in step 311 is positive (Y), the developer discharge setting unit 107 outputs an opening amount reducing instruction of moving the opening amount varying member 80 to the opening driving unit 81Y provided to the yellow developing unit 14Y so that the opening portion of the developer discharge port 79 is reduced from the second opening height Y2 to the first opening height Y1 (step 312), thereby changing the opening portion to the first opening height Y1, and then returns to the step 301 to continue the processing.

On the other hand, when the determination in step 311 is negative (N) and the determination in step 308 is positive (Y), the developer discharge setting unit 107 keeps the opening portion to the second opening height Y2 and returns to the step 307 to continue the processing.

Here, when the height of the opening portion of the developing unit 14 is set to the second opening height Y2, the discharge amount of developer in the developing unit 14 is larger than that when the height of the opening portion is set to the first opening height Y1. This is because in connection with the increase in height of the opening portion, the lowermost position of the opening portion decreases and thus the developer in the developing unit 14 is more liable to overflow.

EXAMPLES

Examples of the exemplary embodiment will be described, however, the exemplary embodiment is not limited to these examples.

The inventors of this application continuously form monochromatic images of cyan on plural sheets P by using the image forming apparatus described above and investigate the quality of the monochromatic images of cyan formed on the sheets P.

Figure 11:
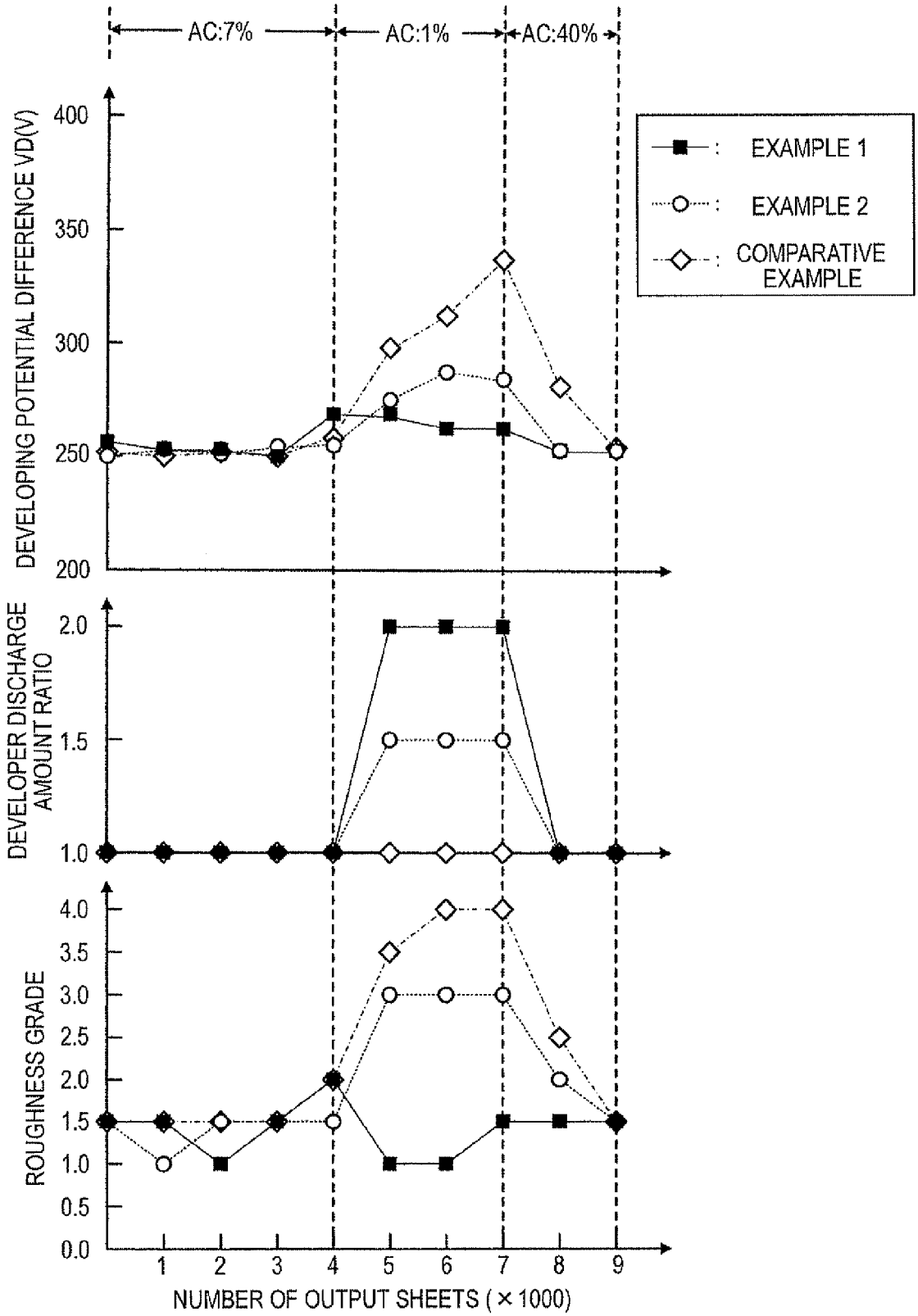
FIG. 11 is a diagram showing examples and a comparative example.

FIG. 11 shows the relationship of the output number of sheets P, the developing potential difference VD in the cyan image forming unit 10C, the developer discharge amount ratio from the cyan developing unit 14C and the roughness grade of cyan monochromatic images formed on the sheets P. In this case, the image formation is performed on totally 9000 sheets P for examples 1 and 2 and a comparative example. Cyan monochromatic images of 7% in image area coverage AC are formed on first 4000 sheets P, cyan monochromatic images of 1% in image area coverage AC are formed on next 3000 sheets P (until 7000 sheets P), and cyan monochromatic images of 40% in image area coverage AC are formed on the last 2000 sheets P (until 9000 sheets P). In the following description, a period for which the cyan monochromatic images of the image area coverage=7% are formed is referred to as "first period", a period for which the cyan monochromatic images of the image area coverage=1% are formed is referred to as "second period", and a period for which the cyan monochromatic images of the image area coverage=40% are formed is referred to as "third period".

Here, the image forming operation is executed under an atmosphere of 25° C. in temperature and 55% in humidity. J sheets (basis weight: 82 gsm) produced by Fuji Xerox Co., Ltd. of JISA3 size are used as the sheets P. Furthermore, the process speed of the image forming apparatus is set to 100 ppm. The reference developer amount Q0 in the developing housing 70 of the cyan developing unit 14C is set to 900 g, and the toner amount at that time is set to 81 g (reference toner concentration TC0=9%). In this example, the reference image area coverage AC0 is set to 5%, and the reference developing potential difference VD0 is set to 270 V.

Furthermore, in the examples 1 and 2 and the comparative example, when the image formation is continuously performed on the 9000 sheets P, the operation of setting the image forming condition shown in FIG. 8 (the resetting of the exposure potential VL) is executed every predetermined number of sheets (for example, every 500 sheets). Therefore, the developing potential difference VD is varied in accordance with the output number of sheets.

Furthermore, in the examples 1 and 2 and the comparative example, the first opening height Y1 is set to 3.0 cm. In the example 1, the second opening height Y2 is set to 6.0 cm, and in the example 2, the second opening height Y2 is set to 4.5 cm. In the comparison example, the second opening height Y2 is set to 3.0 cm. That is, in the examples 1, 2, the image area coverage AC is lower than the reference image area coverage AC0 (in this case, when the image area coverage AC is reduced from 7% to 1%) and the developing potential difference VD exceeds the reference developing potential difference VD0 (in this case, when the developing potential difference VD exceeds 270 V), the developer discharge amount is increased by increasing the second opening height Y2 as compared with the first opening height Y1. On the other hand, in the comparative example, even when the above condition is satisfied, the developer discharge amount is not changed by equalizing the first opening height Y1 and the second opening height Y2 to each other.

Here, in the examples 1, 2 and the comparative example, the developer discharge amount when the opening portion is set to the second opening height Y2 is normalized by the developer discharge amount when the opening portion is set to the first opening height Y1, thereby obtaining the developer discharge amount ratio.

The roughness grade is obtained by visually estimating the roughness of an image formed on a sheet P, and it means that as the numerical value thereof is smaller, the roughness is less (image quality is higher). For example, a roughness grade (0) represents a state that the image has no roughness, a roughness grade (2) represents a state that the image has little roughness, and a roughness grade (4) represents a state that the image has remarkable roughness.

In the comparative example, the developing potential difference VD increases rapidly for the second period. On the other hand, in the example 2, the increasing degree of the developing potential difference VD for the second period is suppressed as compared with the comparative example. In the example 1, the increasing degree of the developing potential difference VD for the second period is further suppressed as compared with the example 2.

Here, in the comparative example, the height of the opening portion of the developing housing 70 is not increased even after the developing potential difference VD exceeds the reference developing potential difference VD0 (270 V) in the second period. Therefore, in the second period, toner which is circulated and carried in the developing housing 70 without being supplied for the development is hardly discharged through the opening portion. In this case, the charging characteristic, etc. of the toner is deteriorated as the amount of toner circulated and carried in the developing housing 70 increases. As a result, in order to perform the development with toner which is hardly charged, the exposure potential VL is adjusted so as to increase the developing potential difference VD. In the comparative example, the development is performed by using deteriorated toner in the second period, and thus the roughness grade is degraded.

On the other hand, in the examples 1, 2, after the developing potential difference VD exceeds the reference developing potential difference VD0 in the second period, the height of the opening portion of the developing housing 70 is increased. Therefore, in the second period, toner circulated and carried in the developing housing 70 is more liable to be discharged to the outside through the opening portion. In connection with this discharge, the amount of new developer supplied to the developing housing 70 in the second period is increased. Accordingly, the amount of toner circulated and carried in the developing housing 70 is reduced as compared with the comparative example, and thus the charging characteristic, etc. of toner is hardly deteriorated. As a result, the adjustment amount of the exposure potential VL to increase the developing potential difference VD may be reduced. Furthermore, in the examples 1, 2, in the second period, the development is performed by using toner which is suppressed from being deteriorated, and thus the roughness grade is enhanced as compared with the comparison example.

Furthermore, in the example 1, the height of the opening portion in the second period is increased as compared with the second example 2, and thus the amount of developer from the developing housing 70 through the opening portion is increased, and thus the amount of new developer supplied to the developing housing 70 is increased. Therefore, in the example 1, the increase of the developing potential difference VD is further suppressed as compared with the second example 2, so that the degradation of the roughness grade is suppressed.

In this case, the reference developing potential difference VD0 is set to 270 V. However, the exemplary embodiment is not limited to this value, and it may be set to a value in the range from 200 V to 400 V. However, the reference developing potential difference VD0 may be set to a value out of this range.

Furthermore, the reference image area coverage AC0 is set to 5%, however, the exemplary embodiment is not limited to this value. For example, the reference image area coverage AC0 may be set so as to satisfy $0\% < AC0 \leqq 20\%$.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holder;

a latent image forming unit that forms an electrostatic latent image containing an image portion and a background portion on the image holder;

a developing unit that develops the electrostatic latent image formed on the image holder with toner, the developing unit including a developer holder that is disposed to face the image holder and holds developer containing the toner and carrier, and a developer container that contains the developer to be supplied to the developer holder;

a replenishing unit that replenishes new developer to the developing unit;

a discharge unit that discharges from the developing unit the developer contained in the developing unit;

a calculation unit that calculates an image area coverage of a toner image formed on the image holder;

an obtaining unit that obtains a potential difference between the developer holder and the image portion on the image holder; and a controller that increases a discharge amount of the developer to be discharged from the developing unit by the discharge unit when the image area coverage calculated by the calculation unit is smaller than a predetermined reference image area coverage, and the potential difference obtained by the obtaining unit is larger than a predetermined reference potential difference.

2. The image forming apparatus according to claim 1, wherein after the discharge amount of the developer from the developing unit by the discharge unit is increased, the controller reduces the discharge amount of the developer from the developing unit by the discharge unit when the image area coverage calculated by the calculation unit is larger than the reference image area coverage and the potential difference obtained by the obtaining unit is smaller than the reference potential difference.

3. The image forming apparatus according to claim 2, wherein the developer container provided to the developing unit has an opening for discharging the developer, and wherein the discharge unit adjusts a size of the opening provided to the developer container.

4. The image forming apparatus according to claim 3, further comprising:

a density detector that detects a density of toner in the developer contained in the developing unit;

a developer amount detecting unit that detects the amount of the developer contained in the developing unit; and a setting unit that sets the amount of developer to be replenished by the replenishing unit and the density of toner in the developer to be replenished on the basis of a detection result of the density of the toner by the density detecting unit and a detection result of the amount of the developer by the developer amount detecting unit.

5. The image forming apparatus according to claim 2, further comprising:

a density detector that detects a density of toner in the developer contained in the developing unit;

a developer amount detecting unit that detects the amount of the developer contained in the developing unit; and a setting unit that sets the amount of developer to be replenished by the replenishing unit and the density of toner in the developer to be replenished on the basis of a detection result of the density of the toner by the density detecting unit and a detection result of the amount of the developer by the developer amount detecting unit.

6. The image forming apparatus according to claim 1, wherein the developer container provided to the developing unit has an opening for discharging the developer, and wherein the discharge unit adjusts a size of the opening provided to the developer container.

7. The image forming apparatus according to claim 6, further comprising:

a density detector that detects a density of toner in the developer contained in the developing unit;

a developer amount detecting unit that detects the amount of the developer contained in the developing unit; and a setting unit that sets the amount of developer to be replenished by the replenishing unit and the density of toner in the developer to be replenished on the basis of a detection result of the density of the toner by the density detecting unit and a detection result of the amount of the developer by the developer amount detecting unit.

8. The image forming apparatus according to claim 1, further comprising:

a density detector that detects a density of toner in the developer contained in the developing unit;

a developer amount detecting unit that detects the amount of the developer contained in the developing unit; and a setting unit that sets the amount of developer to be replenished by the replenishing unit and the density of toner in the developer to be replenished on the basis of a detection result of the density of the toner by the density detecting unit and a detection result of the amount of the developer by the developer amount detecting unit.

* * * * *